United States Patent [19]

Beyl

[11] 3,966,218

[45] June 29, 1976

[54] SKI BINDING WITH INCORPORATED BOOT SUPPORTING PIVOTING PLATE

[76] Inventor: Jean Joseph Alfred Beyl, Blvd. Victor Hugo, Nevers, France

[22] Filed: Mar. 18, 1975

[21] Appl. No.: 559,552

[30] Foreign Application Priority Data

Mar. 25, 1974 France ..... 74.10132

[52] U.S. Cl. ..... 280/618; 280/631; 280/633; 280/634

[51] Int. Cl.[2] ..... A63C 9/081

[58] Field of Search ..... 280/11.35 Y, 11.35 K, 280/11.35 R, 11.35 G, 11.35 T

[56] References Cited

UNITED STATES PATENTS

| | | | |
|---|---|---|---|
| 3,145,027 | 8/1964 | Berchtold et al. | 280/11.35 Y |
| 3,647,235 | 3/1972 | Beyl | 280/11.35 Y |
| 3,687,471 | 8/1972 | Sommer | 280/11.35 T |
| 3,752,491 | 8/1973 | Fend | 280/11.35 K |
| 3,764,155 | 10/1973 | Perryman | 280/11.35 Y |

FOREIGN PATENTS OR APPLICATIONS

| | | | |
|---|---|---|---|
| 1,446,991 | 6/1966 | France | 280/11.35 Y |

*Primary Examiner*—M. H. Wood, Jr.
*Assistant Examiner*—David M. Mitchell
*Attorney, Agent, or Firm*—Bierman & Bierman

[57] ABSTRACT

This safety ski binding with incorporated boot-supporting pivoting plate comprises for supporting the ski boot a pivoting plate adapted to rotate about a pivot member rigid with the ski and provided with boot retaining means, preferably at both toe and heel ends of the boot. These boot retaining means are movably mounted on said plate and held in their operative position in a predetermined area or amplitude of the permissible pivoting movement of the plate, any overstepping of said area or amplitude being attended by a release of the boot. To this end, a feeler connected to the retaining means engages an abutment member rigid with the ski and disposed beneath the pivoting plate, and resilient means reacting between the pivoting plate and the ski produce at least in said area an essentially constant antagonistic torque, said retaining means being slidably mounted along the longitudinal median line of said supporting plate and responsive to spring means constantly urging said feeler for engagement with the control surface of said abutment member so that, in case of release, said retaining means are moved away from the relevant boot end.

10 Claims, 11 Drawing Figures

Fig.1
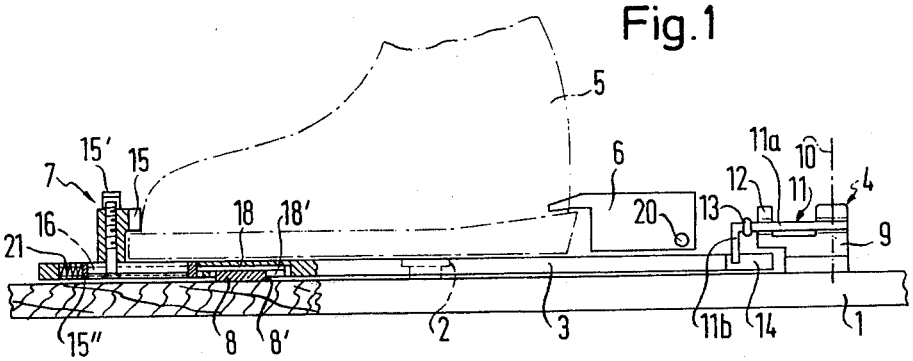
Fig.2
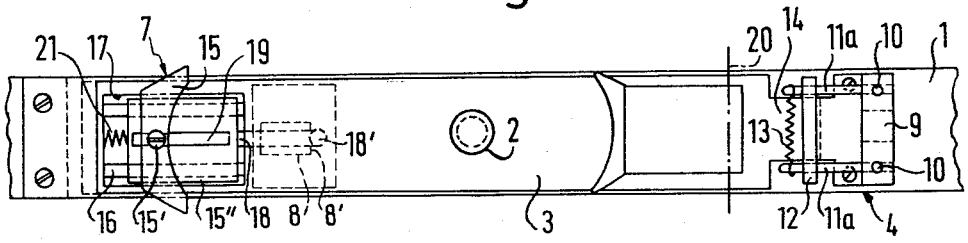
Fig.5
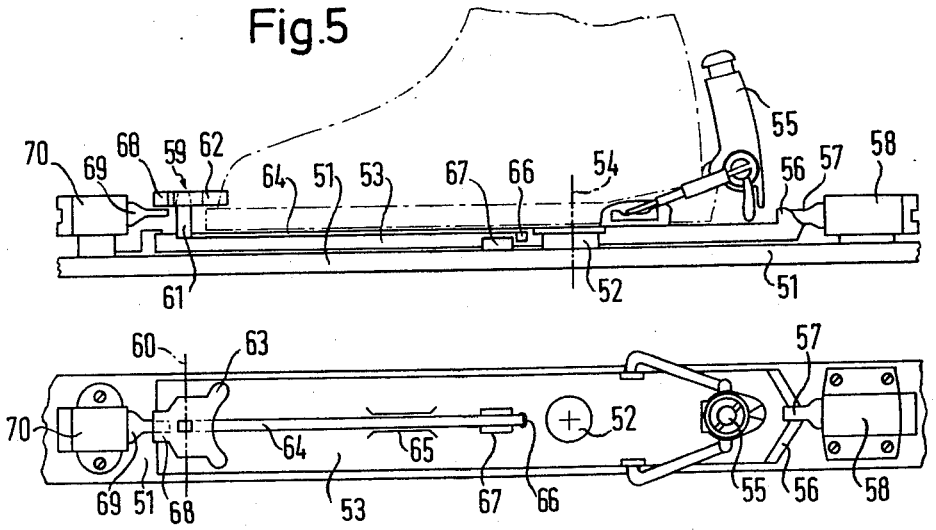
Fig.6

SKI BINDING WITH INCORPORATED BOOT SUPPORTING PIVOTING PLATE

BACKGROUND OF THE INVENTION:

1. Field of the Invention:

The present invention relates in general to safety ski bindings and has specific reference to a safety ski binding incorporating a plate for supporting the ski boot which comprises means for retaining said boot, said plate being pivotally mounted through adequate pivot means to the top surface of the ski.

2. Description of the Prior Art:

This safety ski binding pertains to the type wherein at least the means for retaining the toe end of the ski boot is movably mounted on the supporting plate and held by means of an abutment member rigid with the ski in its boot-retaining position but released when a predetermined angle of pivotal movement is overstepped. The abutment member comprises a control surface extending in the direction of the pivotal movement of the boot supporting plate engaged by a feeler connected to the boot retaining means when this means is in its operative or retaining position, the abutment member being mounted on the ski, beneath the boot supporting plate, and penetrating into the supporting plate wholly or partly by engaging a recess formed in said plate. Furthermore, this safety ski binding comprises a resilient device operative between the ski and the boot supporting plate and adapted, at least in the angular amplitude or area of the permissible pivoting movement afforded by the supporting plate, to produce an antagonistic, substantially constant torque.

In safety ski bindings of this general type the actuation of the release member in the direction to release the ski, boot is independent of the particular shape of the ski boot, or at least the operative members depending on the boot configuration are adapted to co-act with the boot at points thereof having no critical importance as far as the safety function of the binding is concerned. On the other hand, there is a certainty that in case of a skier's fall attended by the release of the safety or retaining system the boot will be separated completely from the supporting plate, so that the skier will not find him- or herself in the unpleasant position of walking on the snow with a plate attached to one or both feet, which may prove extremely dangerous or at least inconvenient, especially on a difficult ground. In a ski binding of this character the movable plate supporting the boot remains constantly attached to the ski.

A ski binding of the type broadly set forth hereinabove is known for example through the French Pat. No. 1,446,991. In this binding, the means for retaining the toe end of the ski boot consist of side jaws detachably connected to the boot supporting plate and retained by an abutment member rigid with the ski in their operative or connecting position with respect to the boot supporting plate when this boot is in its normal skiing position. When the predetermined angular amplitude of movement of the boot supporting plate is over-stepped against the force of the resilient return means acting on said boot, at least one of the feelers holding the above-mentioned jaws is caused to loose its contact with the abutment member, so that one of the jaws is released completely from said laterally moving supporting plate, thus releasing the boot. However, special provisions must be made to prevent one or the other lateral jaw, then completely detached from the plate, from being lost. Another inconvenience lies in the fact that the boot retaining means, i.e. the jaw, when released laterally, must perform not only the plate release movement, since said plate already projects beyond the side edge of the ski, but also another additional lateral movement, causing said boot retaining means to move outside of the ski. This requirement obviously interferes with the desiredly instantaneous boot release action and further implies the risk of damaging the supporting plate and subjecting this plate to abnormal mechanical stress, since the binding elements projecting considerably from the side edge of the ski might easily cause the binding and the ski itself to be driven into the ground surface.

Summary of the Invention:

It is the primary object of the present invention to provide an improved safety ski binding of the general type set forth hereinabove which is so designed that in case of release of the safety device the boot can move laterally away from the supporting plate with a particularly swift movement.

To solve this problem the present invention provides a safety ski binding of the type disclosed hereinabove wherein the means for retaining the toe end of the ski boot is mounted for movement in the direction of the longitudinal axis of the supporting plate, and responsive to spring means constantly urging the feeler for engagement with the control surface and which, in case of release, is adapted to move the toe end retaining means away from the toe end. This arrangement ensures a reliable and swift release of the ski boot, since during said release the toe end retaining means, notably a toe jaw is pulled immediately towards the front end of the ski when the threshold or limit angular movement of the boot supporting plate is over-stepped. This release is obtained through a longitudinal movement of the assembly comprising the boot, the ski and the supporting plate, whereby the boot can move relatively swiftly and laterally away from its supporting plate without requiring a lateral movement of any component element of the binding, more particularly laterally with respect to the boot proper. The means for retaining the toe end of the ski boot (front jaw) remains in its released state in alignment with the longitudinal axis of the supporting plate, without projecting laterally therefrom. Under these conditions, the likelihood of injuring the skier and exerting unduly high mechanical stress against the boot support when the safety device is released, is reduced considerably. In fact, the front jaw components which, in the released condition, project laterally beyond the boot supporting plate, are liable to cause the supporting plate to engage the ground and thus be damaged, not to mention other detrimental consequences for the binding and the skier.

BRIEF DESCRIPTION OF THE DRAWING:

FIG. 1 illustrates diagrammatically in part-sectional elevational view a first typical form of embodiment of the invention;

FIG. 2 is a diagrammatic plan view from above corresponding to FIG. 1;

FIGS. 5 and 6 are a side elevational view and a plan view respectively of another exemplary form of embodiment of this invention;

Figure 3:
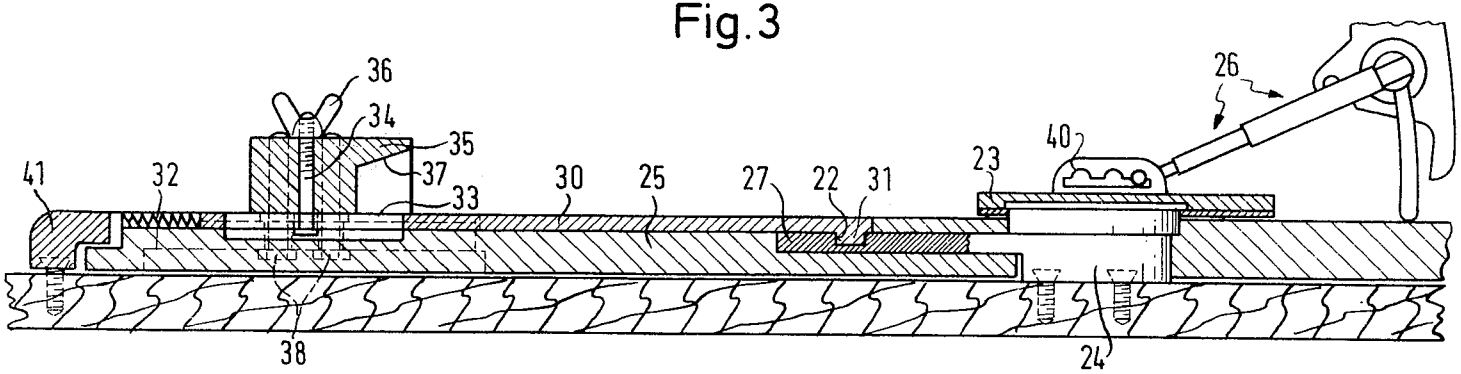
FIG. 3 is a diagrammatic longitudinal section showing a modified form of embodiment.

DESCRIPTION OF THE PREFERRED EMBODIMENTS:

In the example illustrated in FIGS. 1 and 2 of the drawing, the safety ski binding according to this invention comprises a plate 3 constituting the ski boot supporting member; this plate 3 is pivotally mounted on the ski so as to be movable in a plane parallel to the ski top surface about a pivot member 2 rigid with the ski 1. However, this plate 3 cannot be detached from the pivot member 2 and is held in its normal operative position by resilient means mounted on the ski 1 and designated in general by the reference numeral 4. The ski boot 5 is retained on said supporting plate 3 by retaining means 6 and 7. At least one retaining means, denoted 7, associated with the toe end of the boot, is movably mounted on said plate 3 and responsive to control means co-acting with an abutment member 8 rigid with the ski so as to keep said retaining means 7 in its operative position to hold the boot 5 in a predetermined area corresponding to the permissible pivotal movement of said plate 3, and to release said retaining means 7 when the limits of said area are overstepped on one or the other side.

The abutment member 8 rigid with the ski 1 is located between pivot 2 and plate 3, on the one hand, and the area in which the toe end of the ski boot 5 is engaged by the retaining means 7, on the other hand, whereby the lever arm of the forces exerted in the area of said retaining means 7 against the pivot means 2 rigid with the ski 1 is considerably smaller than the distance between the point where these forces are created (retaining means 7) and the location of said pivot 2.

Advntageously, the position of said pivot means 2 rigid with the ski 1 should be located in the plane of the skier's tibia, or at least in close vicinity thereof.

As a consequence of the above-described fundamental disposition of the component elements of the present ski binding and also of the functional properties resulting therefrom, a ski binding is obtained wherein the operation of the member actuating the safety device or releasing the ski boot is independent of the particular shape of the ski boot, or of which at least the operative components depending on the shape of the ski boot (notably the heel hold down member controlling the safety device) co-operate with the boot proper in areas scarcely critical as far as the safety function is concerned. At the same time, a considerable advantage is derived from the fact that the boot is separated completely from the supporting plate in case of a skier's fall attended by an automatic actuation of the safety device, whereby the skier notably on difficult ground is not compelled to walk with a cumbersome plate attached to his boot, as this would be extremely dangerous and inconvenient. In fact, the movable plate remains constantly attached to the ski 1.

More particularly, the resilient means 4 illustrated in FIGS. 1 and 2 comprises a base 9, rigid with the ski 1, to which a pair of lateral arms 11 are pivotally connected about pivot pins 10 for movement in a plane parallel to the top surface of the ski. In the specific form of embodiment illustrated these arms 11 have essentially the shape of an L disposed with its major section 11*a* extending substantially horizontally, the end of this major section remote from the elbow of 1*e* L being pivoted by means of the corresponding pivot pin 10. On the other hand, the minor section 11*b* of each arm 11 extends substantially vertically down to a point located somewhat below the level of the top surface of the above-described supporting plate 3, on either side of a narrower rear extension 14 of said plate 3. To guide and hold these arms 11 in position a substantially T-shaped yoke 12 is provided on said base 9. The horizontal member of this T-shaped yoke 12 extends on either side above said lateral arms 11, at suitable locations, so that these arms 11 cannot be lifted off the ski surface. The vertical or central member of this yoke 12 is located between the lateral arms 11 and acts jointly as an abutment member and as a distance-piece in relation thereto.

Between said lateral arms 11 is anchored at a suitable location a tension coil spring 13 constantly urging said lateral arms 11 towards each other, against the central member of yoke 12 so as to define in combination with said pivot pins 10 the normal position of these arms 11, as illustrated in FIG. 2.

In the space thus defined between the arms 11 the rear extension 14 of plate 3 is disposed preferably in such way that it can be gripped by its edges, i.e. by the minor sections 11*b* of said arms, so as to be held in its proper position on the ski 1. FIG. 1 shows that the yoke 12 can at the same time act as a retaining operative in the vertical direction to prevent any undesired upward movement of supporting plate 3 in relation to the ski 1.

The resilient means 4 is adjustable to meet particular requirements of the skier by modifying the force of tension spring 13. However, this device remains completely independent of the type and/or shape of the ski boot fitted thereto, and furthermore the relationships between the lever arm obtained between the resilient means and the pivot member 2 of supporting plate 3 are determined completely beforehand.

The device 7 for retaining the toe end of the ski boot, in the form of embodiment illustrated in FIGS. 1 and 2, comprises a jaw 15 which, by means of a screw and nut mechanism 15′, is mounted on a plate 15″. This screw and nut mechanism 15′ is so constructed that the position of the jaw with respect to this plate 15″ can be modified at least in the longitudinal direction of plate 15″ which is coincident with the longitudinal axis of the ski.

The plate 15″ supporting the jaw 15 is mounted for longitudinal sliding movement with respect to the median axis of the ski, for example on a pair of guide rods 16 disposed longitudinally in the supporting plate 3 and equally spaced laterally from the longitudinal median axis thereof in a recess 17 provided to this end in supporting plate 3. In said recess 17, ahead of plate 15″ a tension spring 21 is disposed between the supporting plate 3 and the jaw supporting plate 15″. Similarly, a pressure spring could be inserted in said recess 17 behind the plate 15''. In the direction of the pivot member 2 rigid with the ski 1 the jaw supporting plate 15'' has a rod extension 18 engaging by means of a feeler member 18' the abutment member 8 rigid with the ski. The abutment member 8 has a control surface 8' extending in the direction of the pivotal movement of the supporting plate 3 about its pivot member 2, this control surface 8' being engaged by said feeler 18' in the retaining position (i.e. in which the boot 5 is retained by said device 7). The shape and/or dimensions of the control surface 8' and of the corresponding feeler 18' determine of course the predetermined pivot area or permissible angular amplitude of the supporting plate 3 about its pivot 2.

The above-described safety binding operates as follows:

When a torsion stress in excess of the force for which the release torque is adjusted or preset in the resilient means is exerted on the skier's leg during an abnormally long time period, the supporting plate 3 pivots about its pivot member 2. When the feeler 18' as a consequence of this movement is disengaged from the control surface 8' of abutment member 8 rigid with ski 1, as a consequence of the shape and/or dimensions of these components, upon completion of the thus predetermined movement the retaining means 7 can slide freely forwards on its guide rods 16 due to the permanent tension of spring 21 and possibly also of the ski boot 5, whereby the boot 5 is released from its retaining means 6 and/or 7. As an extension of the above-defined control surface 8' the abutment member 8 may comprise guide races and/or resilient means capable of restoring the engagement between the feeler 18' and its control surface 8' subsequent to the disengagement produced between the ski boot 5 and the supporting plate 3. If this possibility is not contemplated, the retaining means may be pushed manually so that the feeler 18' re-engages its control surface 8' when the supporting plate 3 resumes its normal position under the resilient force of spring 13 and of one of the arm 11 of resilient device 4.

The heel hold down device 6 may advantageously consist of a so-called "safety" hold down device adjustable for a predetermined range of essentially vertical efforts exerted on the heel, said heel hold down device being adapted to pivot about a substantially horizontal pivot pin 20 for releasing the boot. Advantageously, the hold down or retaining device 6 is resiliently mounted on the supporting plate 3 and adjustable in the longitudinal direction.

In the various modified forms of embodiment of the invention which are described hereinafter with reference to FIGS. 5 to 11 of the drawings the abutment member and its control surface are located in close vicinity of the pivot member of the boot supporting plate or may even constitute an integral part of said pivot member.

Figure 4:
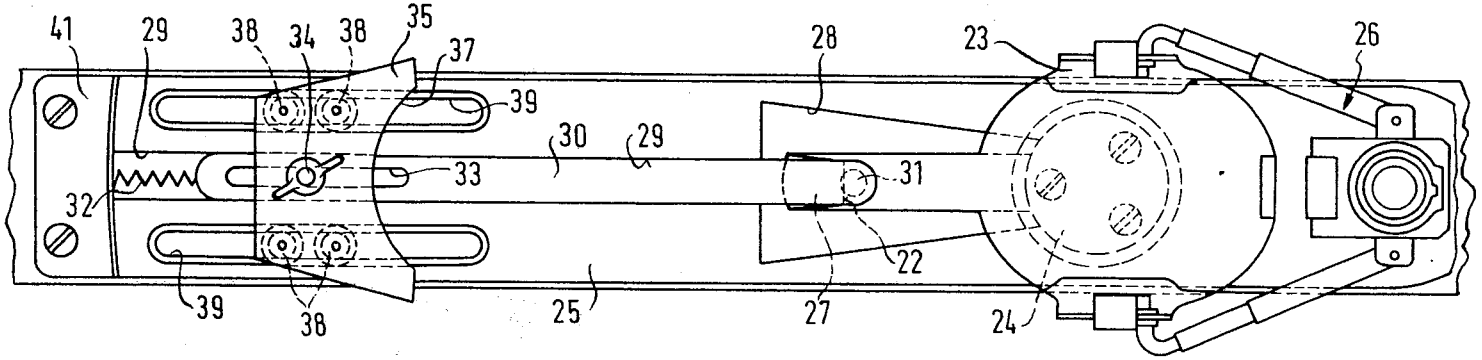
FIG. 4 is a plan view from above of this modified form of embodiment.
Figure 7:
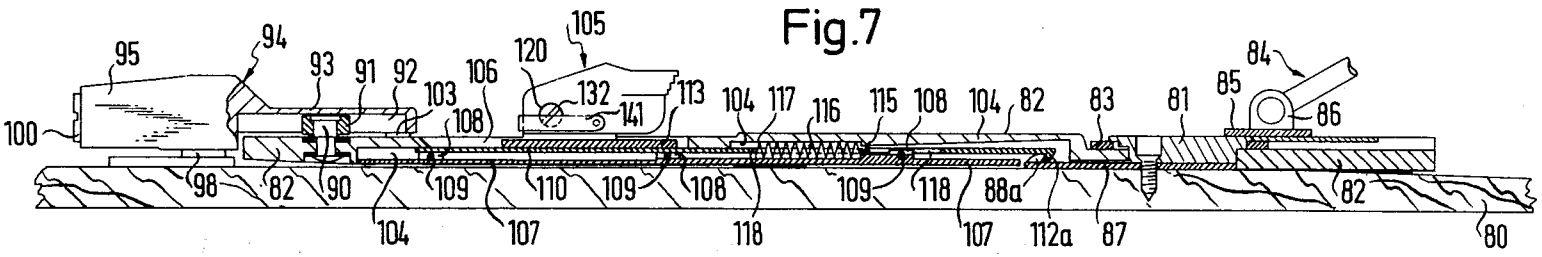
FIG. 7 is a diagrammatic side elevational and part-sectional view of a preferred form of embodiment of the invention.
Figure 8:
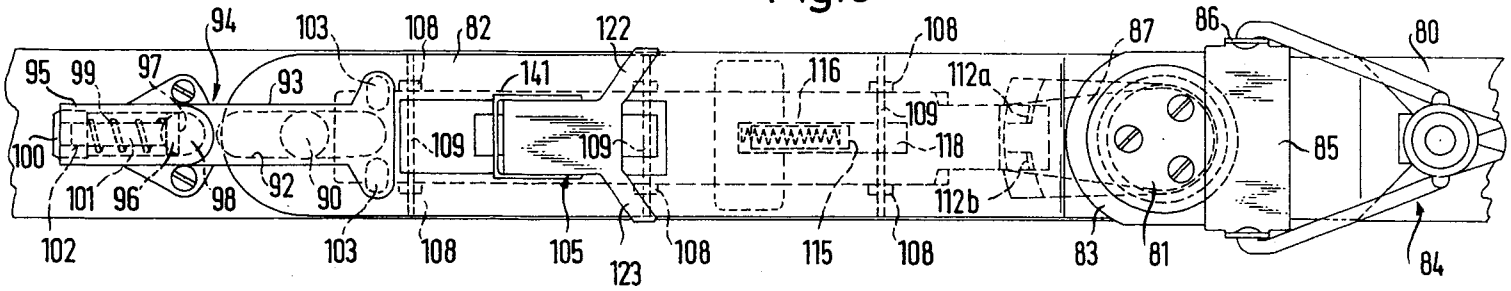
FIG. 8 is a plan view from above of the device shown in FIG. 7.

Thus, in FIGS. 3 and 4 there is shown an advantageous form of embodiment of a ski binding according to the present invention, wherein the pivot member 24 of supporting plate 25 (corresponding to pivot member 2 and supporting plate 3, respectively, of the first form of embodiment described hereinabove with reference to FIGS. 1 and 2) acts at the same time as a pivot means for a swivel platform 23 of a safety heel hold down device 26 of known construction, adapted to release the heel end of the ski boot in case of forward fall of the skier. The pivotal movement of supporting plate 25 about pivot member 24 cannot take place unless a predetermined resilient antagonistic force is overcome, this force being produced by a resilient device (not shown in the drawings) corresponding to the device illustrated in FIGS. 1 and 2, or similar thereto; therefore, a detailed description of this device is not deemed necessary herein.

The abutment member 27 is a one-piece element formed integrally with the pivot member 24, and the supporting plate 25 is formed with a corresponding recess 28. Furthermore, a guide groove 29 is formed in plate 25 for receiving a longitudinal bar 30 adapted to slide therein in the longitudinal direction of the ski. At its end adjacent the pivot member 24 this bar 30 is provided with a feeler 31 engaging the above-described abutment member 27.

A tension spring 32 is disposed between the opposite or front end of bar 30 and plate 25, so as to urge said feeler 31 against the control surface 22 of abutment member 27.

Adjacent its end close to the toe end of the ski boot the bar 30 has formed therethrough an elongated hole 33 engaged by a tightening screw 34 adapted to slide therein in its released condition, the screw head being located beneath said bar. The shank of screw 34 extends through the means 35 for retaining the toe end of the ski boot. By means of an external wing nut or like nut adapted to be easily turned by hand and/or by means of a simple tool, the longitudinal position of said toe retaining means 35 in relation to said bar 30 can easily be adjusted and subsequently locked by tightening the nut 36. Advantageously, the retaining means 35 comprising a jaw 37 shaped for properly engaging the toe end of the ski boot (not shown) is mounted for axial sliding movement on plate 25 and guided by means of guide members 38 engaging corresponding longitudinal laterally spaced guide slots 39 formed in said plate 25 to prevent the retaining means 35 from being lifted off said plate 25. The shouldered front end of plate 25 is covered by a retaining member 41 of corresponding shape, rigid with the ski.

With this arrangement, when the plate 25 is caused to pivot about its pivot member 24 against the resistance or antagonistic force of the resilient device, beyond a predetermined angular amplitude, the contact between the control surface 22 of abutment member 27 and feeler 31 ceases and consequently the retaining means 35, including the bar 30, is moved forwards due to the force exerted by the ski boot and/or the tension spring 32, whereby the boot can be released completely from the safety binding.

Due to the particular configuration of the retaining means 35 and its mounting on bar 30, this ski binding is particularly advantageous, especially in combination with means 40 for a first or rough adjustment of the heel hold down device 26 affording a quick adaptation to various boot sizes. Moreover, this safety ski binding permits the movement of the ski boot in the longitudinal direction to the position desired by the skier in relation to the supporting plate 25 or, more specifically, in relation to its pivot member 24.

FIGS. 5 and 6 illustrate a modified form of embodiment wherein the ski 51 carries a pivot member 52 for pivotally mounting the boot supporting plate 53 about the axis 54 of said pivot member 52 without permitting the lifting of said plate 53 off the ski 51. In the heel area of the device the plate 53 carries a heel hold down device 55 of known construction constituting a safety device becoming operative in case of a forward fall. At its rear end the plate 53 comprises a shaped portion 56 constituting a cam member co-acting with a resilient retaining piston 57 of a spring-urged holding mechanism mounted on the ski proper 51. Said plate 53 is also resiliently retained in position and prevented from pivoting about its pivot member 52 until the release force predetermined by means of said piston and spring mechanism is attained. For retaining the toe end of the ski boot this safety ski binding comprises a device 59 incorporating a jaw 62 pivoted by means of a pivot pin 60 on a support 61. A suitable contour 63 of jaw 62 engages the toe end of the ski boot.

This support 61 is rigid with a bar 64 slidably mounted in a guide groove 65 formed in plate 53. The end of bar 64 adjacent said pivot member 52 engages by means of a feeler 66 an abutment member 67 to keep the holding means 59 in the operative position illustrated in both FIGS. 5 and 6. The jaw 62 is adapted, due to the provision of a front lug extension 68 thereof, to engage an abutment member 69 rigid with the ski 51. In this specific form of embodiment this abutment member 69 is not rigid has a certain adjustable resiliency. In fact, this member 69 is incorporated in a resilient mechanism 70 secured to the top surface of the ski and operating in the fashion of a spring-urged piston. This mechanism constitutes a safety device and its resilient force is adjustable so that in case of rearward fall of the skier the jaw 62 can pivot forwards about its horizontal pivot axis 60 when vertical upward forces are exerted on the toe end of the ski boot and when the release moment of the abutment member 69 is overstepped, this movement being adjustable by means of the resilient mechanism 70.

As a result of the shape and/or dimensions of the front lug extension 68 and of the abutment member 69, beyond a predetermined angular movement accomplished by plate 53 about its pivot 52 against the antagonistic force of the device 58, the lug 68 is released from the abutment member 69, whereby the jaw 62 can pivot freely about its horizontal axis 60 and eventually release the ski boot from the binding. Advantageously, proper cares should be exerted to prevent the front end of plate 53 from being lifted vertically, for example by providing a front retaining member of the type shown at 41 in FIGS. 3 and 4.

In the preferred form of embodiment illustrated in FIGS. 7 to 10 of the drawings the pivot member 81 rigid with the ski 80 has pivoted thereon both the boot supporting plate 82 and the pivoting or swivel platform 83 of a safety heel hold down device 84 of a type already known per se. This swivel platform 83 carries a transverse bar 85 formed with integral lug 86 supporting the arms of a yoke member of a known heel hold down device which may correspond for example to the heel hold down device 26 shown in FIGS. 3 and 4 or to the heel hold down device 55 of FIGS. 5 and 6. This safety heel hold down device may be replaced however by any other suitable type of heel hold down device and its specific form of embodiment is no part of the present invention.

A plate 87 is connected to pivot member 81 and also screwed to the top surface of the ski 80. Said plate 87 extends forwards from pivot member 81 and comprises abutment members **88*a* and 88*b*. The boot supporting plate 82 comprises at its front end a pivot member 90 formed integrally therewith and a slide 91 projecting into an elongated aperture 92 formed in an arm 93 of a resilient device 94 covering the front end of said supporting plate 82. The resilient device 94 consists of a spring-urged piston mechanism comprising within a case 95 carrying the aforesaid arm 93 rigid therewith a piston 96 bearing against a seat 97 formed on a pivot member 98 rigid with the ski. The piston 96 is responsive to the force of a compression spring 99 of which the force is adjustable by means of a screw plug 100 closing the case 95 at the front end thereof. Moreover, said piston 96 comprises an integral rod 101 guided in a cavity 102 of said screw plug 100. The rear end of arm 93 carries on its surface registering with the boot supporting plate 92 a pair of slides 103 having a relatively low coefficient of friction, which bear against the upper surface of plate 82 and prevent any wedging from occuring between the plate 82 and said arm 93, even in case of flexion of said ski 80, during the pivotal movement of the plate and against the antagonistic force of the resilient device 94 which might result from a faulty engagement of the spring-loaded piston with its seat 97 formed on said pivot member 98**.

The lower surface of supporting plate 82 which engages the ski 80 comprises a recess 104 continued by an orifice 106 opening upwards in the area of the device 105 for retaining the toe end of the ski boot. This recess 104 is intended for receiving a set of rods for the retaining means 105 to be described presently in detail. The recess 104 is closed at its lower end by a plate 107 connected to the boot supporting plate 82 by means of apertured lugs 108 adapted to receive transverse bars 109.

These bars 109 carry within said recess 104 and in the longitudinal direction of the supporting plate 82 and ski 80 a plate 110 supporting at its rear end a control extension lug 111 provided with feelers **112*a* and 112*b* engaging the control surfaces 89, 89*a* and 89*b* when the safety binding is in its normal operative position. In the area occupied by said orifice 106 the plate 110 comprises a dovetail portion 113 (FIG. 11) surrounded by a base member 114 of corresponding configuration, as will be described more in detail hereinafter; this element is intended for adjusting the longitudinal position by means of the retaining element 105**.

The lower cover plate 107 closing said recess 104 incorporates in a guide and stop member 115 a compression spring 116 bearing with its front end 117 against the wall of a cavity 118 formed in the lug-supporting plate 110. In order to reduce the vertical dimensions of the structure, said guide and stop member 15 and compression spring 116 engage partly or wholly the cavity 118 of said lug-supporting plate 110.

Figure 9:
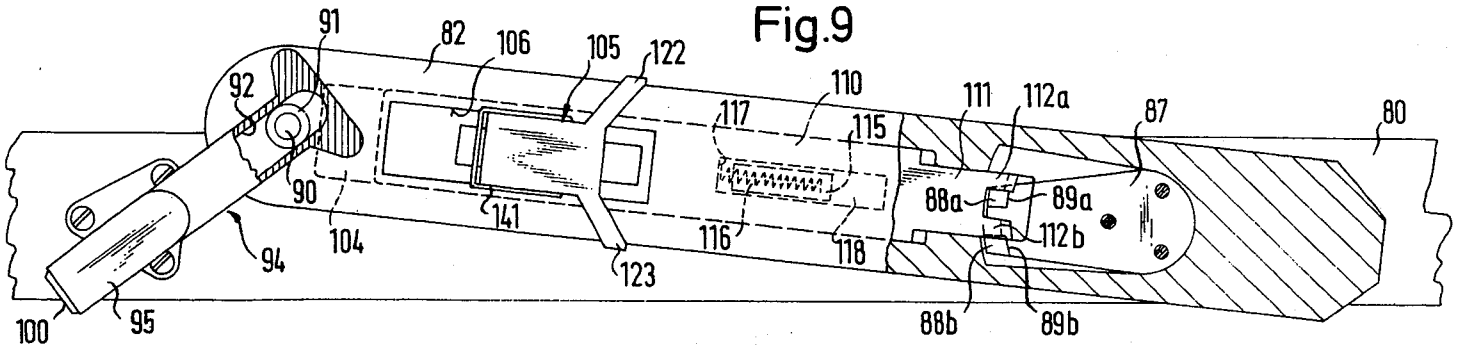
FIG. 9 is a plan view similar to FIG. 8 but showing the safety device in the released condition.
Figure 10:
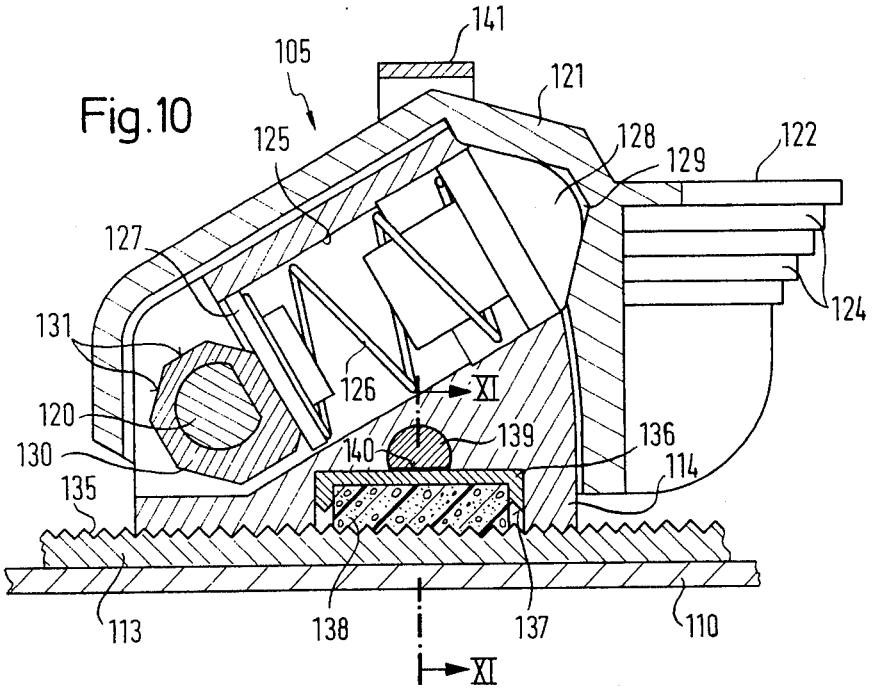
FIG. 10 is a sectional view of the toe end jaw of the safety ski binding of FIGS. 7 – 9.
Figure 11:
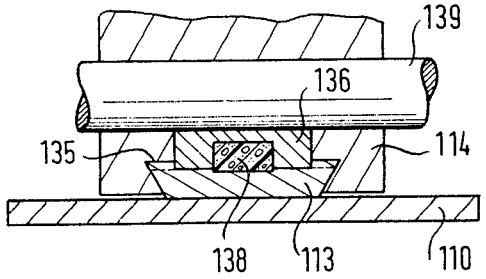
FIG. 11 is a fragmentary sectional view taken along the line XI—XI of FIG. 10.

The detailed description of the construction of retaining means 105 for the toe end of the boot will now be described with reference to FIGS. 10 and 11. A member 121 pivoting about a pivot pin parallel to the top surface of the ski and disposed transversely thereto is pivoted to the lower surface of the base member 114 surrounding the dovetail guide means 113 already described hereinabove. The pivoting member 121 consists of a sturdy case covering almost completely the base body 114 and pivotally mounted about a pivot pin 120 so disposed in said base body 114 that it can rotate for reasons to be explained presently. The pivoting member 121 comprises lateral arms 122, 123 shaped and adapted to retain the edge of the ski boot sole (see also FIG. 9). These arms 122, 123 extend obliquely so as to diverge from each other on the boot side, and comprise a plurality of steps 124 so that they can receive soles of different thicknesses. The base body 114 comprises a bore 125 disposed radially in relation to pivot pin 120 and therefore to the pivot axis of pivoting member 121. This bore contains a coil compression spring 126 reacting with one end against an abutment member 127 provided in the bottom of bore 125 and with the opposite end against a stop member 128 coacting in turn with a recess 129 formed in said pivoting member 121. The abutment member 127 engages a prismatic body 130 rigid with the rotary pivot pin 120 in the base member 114. This prismatic body 130 comprises a plurality of abutment or cam faces 131 disposed at different radii from the axis of pivot 120. By rotating the latter by means of a suitable tool engaging a slot 132 (FIG. 7) it is possible, by properly selecting the cam face 131 registering with abutment member 127, to adjust at will the force of spring 126 and therefore the force with which the stop member 128 is caused to engage said recess 129. As clearly shown in the drawings, the retaining device 105 is so constructed that in case of rearward fall of the skier, that is, when the arms 122, 123 are urged upwards with a force exceeding that holding the member 128 in said recess 129, said pivoting member 121 moves forwards and upwards, thus releasing the toe end of the ski boot.

The longitudinal position of retaining device 105, i.e. the distance between this device and the heel hold down device 84 in order to adapt same to various boot sizes, is adjusted by moving the base member 114 in relation to the plate 110. To this end, the dovetail member 113 rigid with said plate 110 has its upper face formed with a series of teeth 135 to constitute a kind of rack. At its lower portion said base body 114 comprises a cavity receiving a lock member 136 formed with a toothed contour 137 matching said teeth 135. The lock member 136 is normally kept away from said teeth 135 by a spring loaded member 138 bearing against said lock member 136. An eccentric consisting of a rotary pin or like member 139 formed with a flat surface 140 is housed in said base body 114 and engages the upper surface of said lock member 136. The pivot pin 139 projects from either side of said base body 114 and said pivoting member 121, and carries a clamping strap 141. Thus, by pivoting the strap 141 from the position shown in FIG. 10 to the latched position illustrated in FIGS. 7, 8 and 9, the flat face 140 of pin 139 is clamped against the stop member 136 and the serrated contour 137 thereof is engaged with the corresponding locking contour 135 against the force of spring-loaded member 138. The body 114 is prevented from being lifted off the member 113 connected to said plate 110 on account of the dovetail configuration of the joint formed between aforesaid member 113 and said base body 114. With the above-described device, the retaining device 105 can slide in the longitudinal direction when the clamping strap 141 is lifted as shown in FIG. 10, and when said strap 141 is lowered (FIGS. 7, 8 and 9) it can be stopped instantaneously in any desired detent-position.

The operation of this device in case of rearward fall of the skier has already been described hereinabove with reference to the mode of operation of the retaining device 105. When a lateral torsion is exerted on the skier's leg with a force greater than the release torque adjusted beforehand by means of the resilient device 94, the supporting plate 84 rotates about its pivot member 81 and causes the aforesaid resilient device 94 to pivot and to drive the pivot member 90 thereof, as shown in FIG. 9. When the pivotal movement of plate 82 has an amplitude sufficient to cause the feelers **112*a* and 112*b* of control lug 111 to move away from the relevant control surfaces 88*a* and 88*b*, respectively, the control lug 111 and therefore the plate 110 are caused to slide in the forward direction, due to the force of coil compression spring 116. At the same time, the retaining device 105 is moved towards the front end of the ski, thus releasing immediately the toe end of the ski boot. Now due to the fact that, when the toe end of the ski boot has been released, the plate 82 is no more responsive to the torsion stress and on the other hand the return force exerted by the resilient device 94 is still effective, the supporting plate 82 tends to resume its normal position. This fact and the return of said retaining device 105 to its normal position is permitted in a particularly simple manner by causing said retaining device 105 to be pushed back against the antagonistic force of spring 116 through a distance sufficient to enable the feelers 112*a* and 112*b* to resume their normal position of engagement with the relevant control surfaces 88*a* and 88*b*. Finally, it is not deemed necessary to explain in detail the mode of operation of the safety heel hold down device 84** since this mode of operation is known per se.

Without any further analysis, the foregoing will so fully reveal the gist of the present invention that others can, by applying current knowledge, readily adapt if for the various applications without omitting features that, from the standpoint of prior art, fairly constitute essential characteristics of the generic or specific aspects of this invention and, therefore, such adaptations should and are intended to be comprehended within the meaning and range of equivalence of the following claims.

What I claim as new is:

1. A safety ski binding comprising a pivot member rigid with the ski, a pivoting plate means for supporting a ski boot, said pivoting plate being rotatably mounted on said pivot member, an abutment member mounted on said ski adjacent said pivoting plate, first and second ski boot retaining means mounted on said pivoting plate for releasably retaining the toe and heel ends of the boot, respectively, on said pivoting plate; means for slidably mounting said first retaining means on said pivoting plate; first resilient means for urging said first retaining means away from the toe end of the boot, and feeler means connected to the first retaining means and removably engageable with said abutment member, said feeler means engaging said abutment member to normally prevent sliding movement of said first retaining means away from the boot toe, said feeler means being pivotable with said pivoting plate and movable away from said abutment member after said pivoting plate has pivoted a selected distance to permit the first resilient means to slide said first retaining means along the pivoting plate to release said boot from the binding, and second resilient means mounted on said ski and coacting with said pivoting plate, said second resilient means applying a return torque to said pivoting plate upon pivoting movement thereof at least during pivoting movement over said selected distance.

2. The ski binding as set forth in claim 1 further comprising guide means on said pivoting plate for guiding the sliding movement of said first retaining means and for retaining the first retaining means on said pivoting plate.

3. The ski binding as set forth in claim 2 wherein said abutment member is provided with a control surface for engaging said feeler means to normally prevent sliding movement of said first retaining means, said abutment member being located adjacent said pivot member, said feeler means comprising an extension connected at one end thereof to the first retaining means and a feeler member integral with one end of the extension for engaging the control surface of the abutment member.

4. A ski binding as set forth in claim 3 wherein said extension comprises a control bar mounted for longitudinal sliding movement in a guide member of said boot supporting plate, said first retaining means being mounted in an adjustable position at one end of the control bar, the opposite end of said bar carrying said feeler member.

5. A ski binding as set forth in claim 3, wherein said abutment member comprising said control surface is formed directly on the pivot member.

6. A ski binding as set forth in claim 5, wherein said control surface is spaced from the said first retaining means and consists essentially of two abutment surfaces separated from each other and lying on both sides of the longitudinal axis of said pivoting plate, said feeler member consisting of two elements engageable with each of said abutment surfaces.

7. A ski binding as set forth in claim 6, wherein the first retaining means comprises a sole clamping member pivotally mounted about a pivot member parallel to the pivoting plate and transversely to the longitudinal axis of said pivoting plate and release means for holding the sole clamping member in a predetermined position in relation to said first retaining means.

8. A ski binding as set forth in claim 7, wherein the said release means comprises a member rigid with the ski and engaged in the boot retaining position by said sole clamping member through the medium of a lug, for at least as long as the pivotal movement of said pivoting plate remains within predetermined limits.

9. A ski binding as set forth in claim 7 wherein said first retaining means further comprises a base and means for releasably clamping said base to said control surface, said sole clamping member consisting of a pivoting member covering said base, a coil compression spring being housed in a bore formed in said base and extending essentially radially in relation to the pivot axis of said pivoting member, said spring reacting at one end against an adjustable abutment member rigid with said base and exerting with its opposite end a pressure against a stop member, said pivoting member having a recess therein for receiving said stop member, said stop member preventing pivoting movement of said pivoting member when said stop member is engaged with said recess, said stop member being movable against the pressure of the spring to release the pivoting member upon application of an upward force to said pivoting member sufficient to move said stop member back against the force of said spring.

10. A ski binding as set forth in claim 9 wherein said means for releasably clamping said base to said control surface comprises a guide means fixedly mounted to said control surface and a lock member mounted in said base portion, said lock member and said guide means having facing cooperating teeth thereon, resilient means between said lock member and said guide means for normally biasing the lock member away from said guide member to permit sliding movement therebetween to permit adjustment of the longitudinal position of the first retaining means on the ski, and an eccentric positioned on said base and adjacent said lock member, said eccentric being rotatable between a first position in which said lock member and said guide means are not in engagement and a second position in which said lock member and guide means are in engagement.

* * * * *